US010087921B2

(12) United States Patent
Herrera et al.

(10) Patent No.: US 10,087,921 B2
(45) Date of Patent: Oct. 2, 2018

(54) PREVENTING DEFORMATION OF FRAME ON A RECIPROCATING COMPRESSOR

(71) Applicant: GE Oil & Gas Compression Systems, LLC, Houston, TX (US)

(72) Inventors: Robert Lee Herrera, Rockwall, TX (US); Aniruddha Ketkar, Houston, TX (US); Federico Pamio, Houston, TX (US); Kent Pearl, Katy, TX (US); Karthik Ramakumar, Houston, TX (US)

(73) Assignee: GE Oil & Gas Compression Systems, LLC, Houston, TX (US)

( * ) Notice: Subject to any disclaimer, the term of this patent is extended or adjusted under 35 U.S.C. 154(b) by 376 days.

(21) Appl. No.: 15/007,284

(22) Filed: Jan. 27, 2016

(65) Prior Publication Data

US 2017/0211564 A1 Jul. 27, 2017

(51) Int. Cl.
*F04B 53/16* (2006.01)
*F04B 39/12* (2006.01)

(52) U.S. Cl.
CPC ..... *F04B 39/12* (2013.01); *F04B 39/121* (2013.01)

(58) Field of Classification Search
CPC ..... F04B 39/12; F04B 39/121
USPC ..... 92/146, 161
See application file for complete search history.

(56) References Cited

U.S. PATENT DOCUMENTS

| | | | | |
|---|---|---|---|---|
| 1,429,829 | A | 9/1922 | Baker | |
| 2,232,430 | A * | 2/1941 | Benedek | F16H 57/031 60/325 |
| 4,348,871 | A | 9/1982 | Androff | |
| 2013/0251562 | A1 | 9/2013 | Roof et al. | |
| 2017/0211564 | A1 | 7/2017 | Herrera et al. | |

FOREIGN PATENT DOCUMENTS

| | | | |
|---|---|---|---|
| DE | 14 03 963 | A1 | 11/1968 |
| DE | 10 2011 056578 | A1 | 6/2013 |
| FR | 389 215 | A | 9/1908 |
| FR | 2 934 185 | A1 | 1/2010 |
| WO | 99/15791 | A1 | 4/1999 |
| WO | 2008/010490 | A1 | 1/2008 |
| WO | 2010/012891 | A1 | 2/2010 |
| WO | 2017/132492 | A2 | 8/2017 |

OTHER PUBLICATIONS

International Search Report and Written Opinion issued in connection with corresponding PCT Application No. PCT/US2017/015309 dated Aug. 1, 2017.

* cited by examiner

*Primary Examiner* — Michael Leslie
(74) *Attorney, Agent, or Firm* — Paul Frank + Collins P.C.

(57) ABSTRACT

A stability mechanism that can reduce deformation of a frame of a compressor. The stability mechanism can have a support member with an x-shaped configuration having a pair of peripheral members and diagonal components disposed therebetween. In use, the support member can work in combination with elongated "tie bars" to prevent deformation of the frame that may result from installation and/or use of the compressor.

18 Claims, 8 Drawing Sheets

PREVENTING DEFORMATION OF FRAME ON A RECIPROCATING COMPRESSOR

BACKGROUND

Engineers expend great efforts to improve performance and efficiency of industrial machines. These machines include complex systems that are configured to operate on fluids (e.g., liquids and gasses). Improvements may address various areas including structure and control of the machine(s). These improvements may increase operating efficiency and/or reduce capital expenses and operating costs for the machine.

SUMMARY

The subject matter of this disclosure relates, generally, to improvements in the structure of industrial equipment that act on a working fluid to distribute the working fluid under pressure. The term "compressor" can embody reciprocating compressors, examples of which are noted herein, as well as other compressors, pumps, and blowers, wherein at least one difference between different types of this equipment may reside in the operating pressure of working fluid that exits the machine.

Some embodiments incorporate a stability mechanism with physical characteristics to resist deformation in multiple directions. This stability mechanism can find use in the compressor, particularly as part of the frame that houses the shaft and bearings. In one implementation, the stability mechanism includes a centrally-located support member and several peripherally-located members, or "tie bars," that may function to reduce deformation in the frame.

BRIEF DESCRIPTION OF THE DRAWINGS

Reference is now made briefly to the accompanying drawings, in which.

Figure 1:
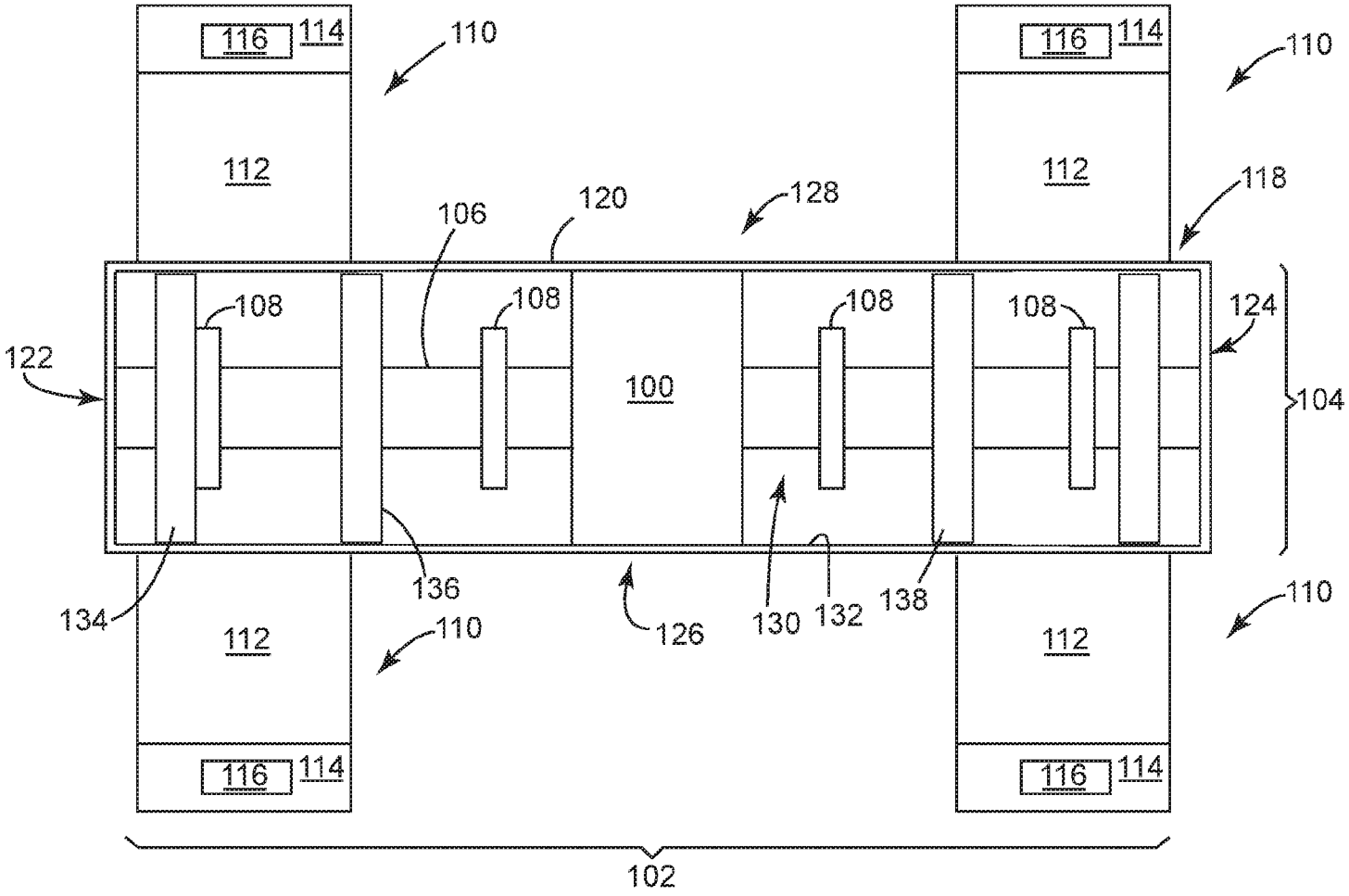
FIG. 1 depicts a plan view for an exemplary embodiment of a support member as part of a compressor.

Where applicable like reference characters designate identical or corresponding components and units throughout the several views, which are not to scale unless otherwise indicated. The embodiments disclosed herein may include elements that appear in one or more of the several views or in combinations of the several views. Moreover, methods are exemplary only and may be modified by, for example, reordering, adding, removing, and/or altering the individual stages.

DETAILED DESCRIPTION

The discussion below describes various embodiments of a support member that can reduce deformation in a frame of a compressor. These embodiments are configured for multi-directional support. When in position in a compressor, the support member can prevent deformation that can occur during installation and/or use of the compressor. Other embodiments of the support member are within the scope of the disclosed subject matter.

FIG. 1 illustrates a schematic diagram of a plan view of an exemplary embodiment of a support member 100 to provide structural support to a frame of a compressor. This embodiment is part of a compressor 102 that may find use in industrial applications to move hydrocarbon fluids. Exemplary applications include gas processing and refineries, although the subject matter herein may extend to other industries as well. The compressor 102 can embody a reciprocating machine with a central (or main) frame 104 that houses a shaft assembly with a shaft 106 and bearings 108. The reciprocating machine can also have one or more piston members 110 disposed laterally about the central frame 104 relative to the shaft 106. Each of the piston members 110 may have a guide member 112 and a piston housing 114. The guide members 112 can be interposed between the central frame 104 and the piston housing 114. During operation, the shaft 106 rotates to actuate a piston 116 inside of the piston housing 114. The action of the piston 116 can pressurize a working fluid for transit through, e.g., a pipeline, a conduit, or related fluid system.

The support member 100 forms at least part of the structure of the central frame 104. This structure can include a unit 118 with members 120 that form ends (e.g., a first end 122 and a second end 124) and sides (e.g., a first side 126 and a second side 128). The members 120 bound an interior cavity 130 with an opening 132 for access to the parts of the reciprocating machine that reside therein. Due at least in part to the size and duty requirements on the reciprocating machine, the members 120 can be made of steel, often as plates that fasten with one another using known and/or after-developed fastening techniques; non-limiting examples of these techniques (at the present writing) include welding and bolting. The plates may include features (e.g., openings, apertures, etc.) as necessary to allow access to the interior cavity 130. These features may facilitate construction, maintenance, and repair of the compressor 102. In addition to the support member 100, the structure can also include one or more peripheral tie bars (e.g., a first tie bar 134, a second tie bar 136, and a third tie bar 138).

The support member 100 and one or more of the tie bars 134, 136, 138 form a stability mechanism. As shown in FIG. 1, examples of the stability mechanism may span across the opening 132 to couple with a portion of the members 120, for example, at sides 126, 128. The support member 100 may be disposed in the interior cavity 130 proximate the top and between two of the bearings 108. A pair of tie bars 136, 138 may be disposed on either side of the support member 100. As noted more below, the support member 100 may embody a pair of peripheral members, each having an elongated, rectangular body that couples with the members 120 and a pair of diagonal components that extends between the peripheral members.

The stability mechanism may be configured to improve mechanical properties (e.g., stiffness) of the unit 118. These improvements can prevent deformation in more than one direction (e.g., lateral, longitudinal, and diagonal). For example, despite its robust, steel components, the unit 118 may change in dimensions during installation and/or use of the compressor. Such changes, while small, can misalign the bearings 108 enough to induce wear, galling, fatigue, and like failure conditions. Inclusion and/or use of the stability mechanism can help to maintain alignment of the bearing 108 before, during, and after installation of the compressor 102. This feature can avoid the onset of failure conditions to ensure that the bearings 108 can reach their useable life and prevent unnecessary maintenance and/or repair of the compressor 102, often at significant costs of labor and machine downtime.

The support member 100 can be configured to provide multi-dimensional support to the unit 118. This multi-dimensional support can manifest in several directions including, for example, at least two of lateral, longitudinal, and diagonal directions. These configurations can utilize metals (e.g., cast iron and/or steel) and metal-alloys. Other materials with sufficient strength and rigidity may also be useful to effectively stabilize and support the unit 118 under loading that occurs during, e.g., installation and/or use of the compressor 102. The support member 100 may have a form factor that is dimensionally larger than the tie bars 134, 136, 138. This form factor may be selected to limit deformation of the unit 118 to ensure proper functionality of the compressor 102. In one implementation, construction of the support member 100 can meet specifications for certain operating conditions.

The tie bars 134, 136, 138 can be configured to provide lateral support to the box-like unit 118. These configurations can have an elongated body, typically constructed from steel, although other materials may also suffice. This construction can have a cross-section that is square or rectangular. But another cross-section may be selected because of its geometric and/or structural qualities as relates to design, construction, or performance of the stability mechanism and/or the compressor 102, generally. In use, the elongated body can have a length situated to allow the tie bars 134, 136, 138 to secure with the sides 126, 128. The length may correspond with dimensions for the opening 132 that are desired or "ideal." It is also contemplated that the length may be set based on manufacturing tolerances. These tolerances may cause the elongated body to slide in place between the sides 126, 128, whether as a loose slip fit and/or press or interference fit. In some implementations, the elongated body may require machining and/or some type of post-processing to ensure that the fit does not induce unnecessary distortion in the box-like unit 118.

The stability mechanism can form a two-dimensional surface area that covers a surface area that is less than the total surface area of the opening 132. This feature permits visual and physical access to the interior cavity 130 of the unit 118. Access into (or via) the unit 118 may be important to facilitate maintenance of the compressor 102. As viewed in FIG. 1, the surface area of the stability mechanism can include the support member 100 and the tie bars 134, 136, 138. The surface area can define a first area and a second area, one each that corresponds with the support member 100 and with the elongated body of tie bars 134, 136, 138 in the aggregate. In one implementation, the surface area of the stability mechanism is approximately 25% of the total surface area of the opening 132.

The stability mechanism can be located in the opening 132 to allow service on parts in the unit 118. This feature may allow access directly to the parts, without the need to remove and/or extract the stability mechanism from the opening 132. However, in one implementation, this disclosure does consider that the stability mechanism can remove from the opening 132, in whole or in part, to facilitate maintenance as necessary. Fasteners like bolts may penetrate through the members 120 into the material of one or more of the support member 100 and the tie bars 134, 136, 138. These fasteners can use threads that can withstand the stress, strain, and other physical properties to properly secure and support the components in position in the unit 118.

Figure 2:
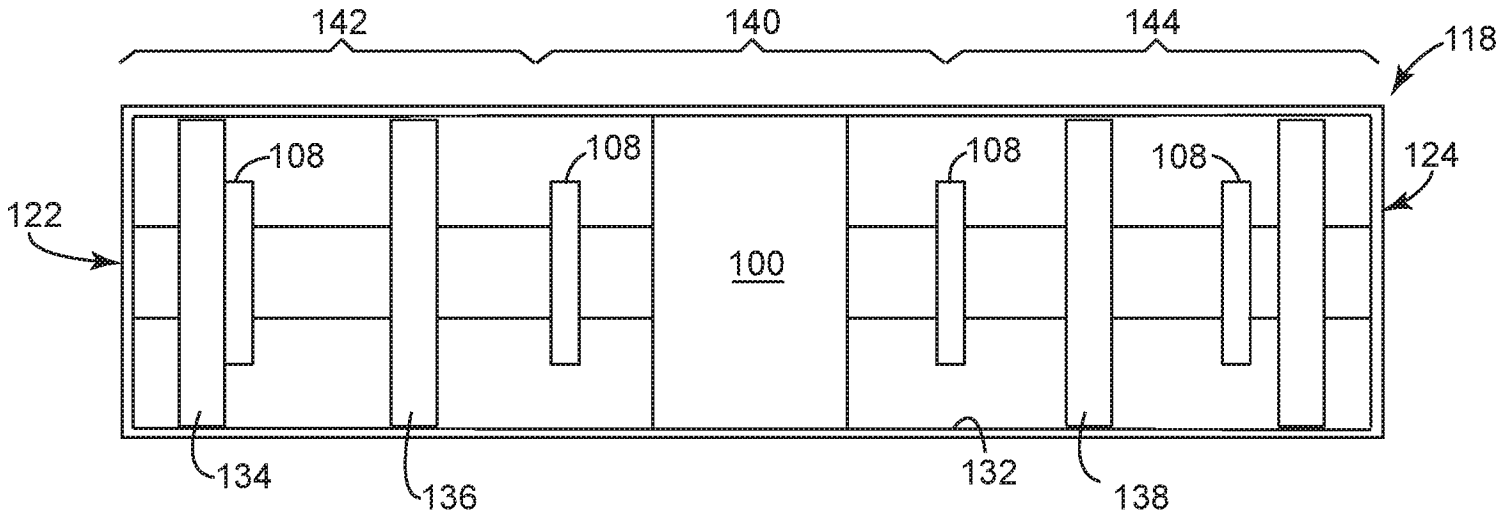
FIG. 2 depicts a detail plan view of an example of the support member and compressor of FIG. 1.

FIG. 2 depicts a plan view of the compressor 102 of FIG. 1 to show details of an example of the stability mechanism. The opening 132 can have a middle portion 140 and a pair of peripheral portions (e.g., a first peripheral portion 142 and a second peripheral portion 144). As noted above, the stability mechanism can locate the support member 100 and the tie bars 134, 136, 138 in a position in the opening 132 to facilitate access to the components in the interior cavity 130. These positions may also reduce deformation in the box-like unit 118 and, where necessary, accommodate for the form factor of the support member 100. In one implementation, the support member 100 can reside in the middle portion 140, often between two of the bearings 108. This position may be offset from the centerline of the box-like unit 118 towards either end 122, 124. The tie bars 134, 136, 138 may reside in the peripheral portions 142, 144. In the present example, the position of the tie bar 134 can be proximate but offset from the first end 122. This position may require maintenance personnel to remove the tie bar 134 in order to access the resident bearing 108. As shown in FIG. 2, the tie bars 136, 138 can reside in a position between two of the bearings 108.

Figure 3:
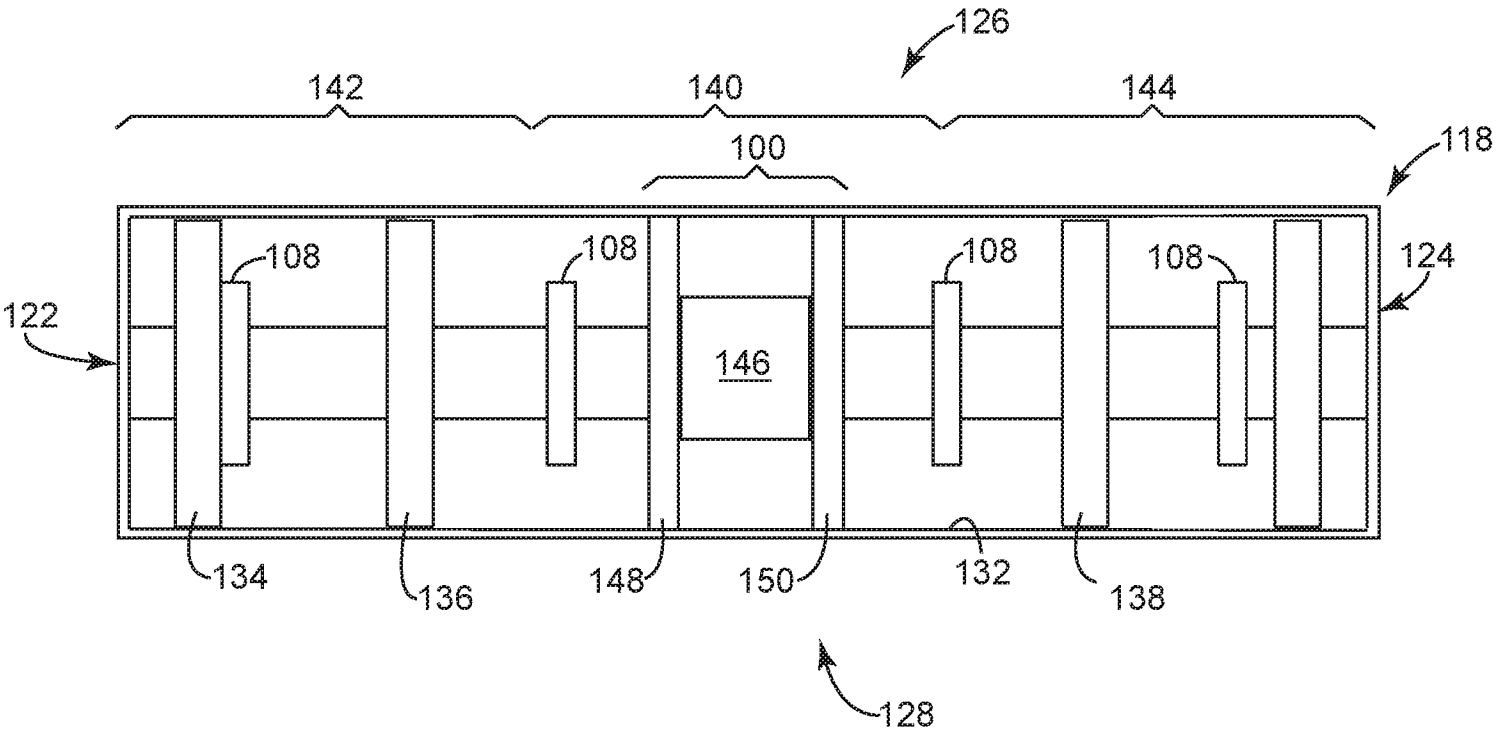
FIG. 3 depicts a detailed plan view of an example of the support member for use in the compressor of FIGS. 1 and 2.

FIG. 3 illustrates a plan view of the compressor 102 of FIG. 1 to show details of an example of the support member 100 located in the frame 104 of the compressor 102. This example has a multi-component structure that can be configured to provide the structural stability contemplated herein. Exemplary configurations may include a central member 146 and one or more lateral members (e.g., a first lateral member 148 and a second lateral member 150). The members 146, 148, 150 may be formed unitarily and/or monolithically, similar to manufacture as a casting and/or a cast part. Secondary operations may be useful remove material to form certain features that are not subject to and/or conducive to casting. Moreover, this disclosure does contemplate configurations that use multiple pieces. Such configurations might be more typical of a weldment and/or a unit that employs fasteners (e.g., bolts) to secure the members 146, 148, 150 to one another. In such configurations, one or more of the central member 146 and the peripheral members 148, 150 may embody individual pieces that are coupled with other individual pieces, using known and/or after-developed fastening techniques; non-limiting examples of these techniques (at the present writing) include welding and bolting.

The peripheral members 148, 150 may be configured to secure with the sides 126, 128 on the unit 118. These configurations may utilize an elongated body with a form factor similar to the tie bars 134, 136, 138. This form factor may be of the same size, shape, and cross-section. However, some deviations may be required for the support member 100 to retain physical properties sufficient to resist deformation in the box-like unit 118.

The central member 146 can be configured to couple with the peripheral members 148, 150. These configurations should have a body with geometry that imparts rigidity in the support member 100 that is greater than the rigidity of each of the peripheral members 148, 150 individually. At a high level, the geometry can assume a variety of unique and/or characteristics shapes, forms, sizes, etc. These shapes can be selected, combined, and/or modified to obtain the physical properties for the support member 100, often in connection with specified and/or implied loading on the central frame 104.

Figure 4:
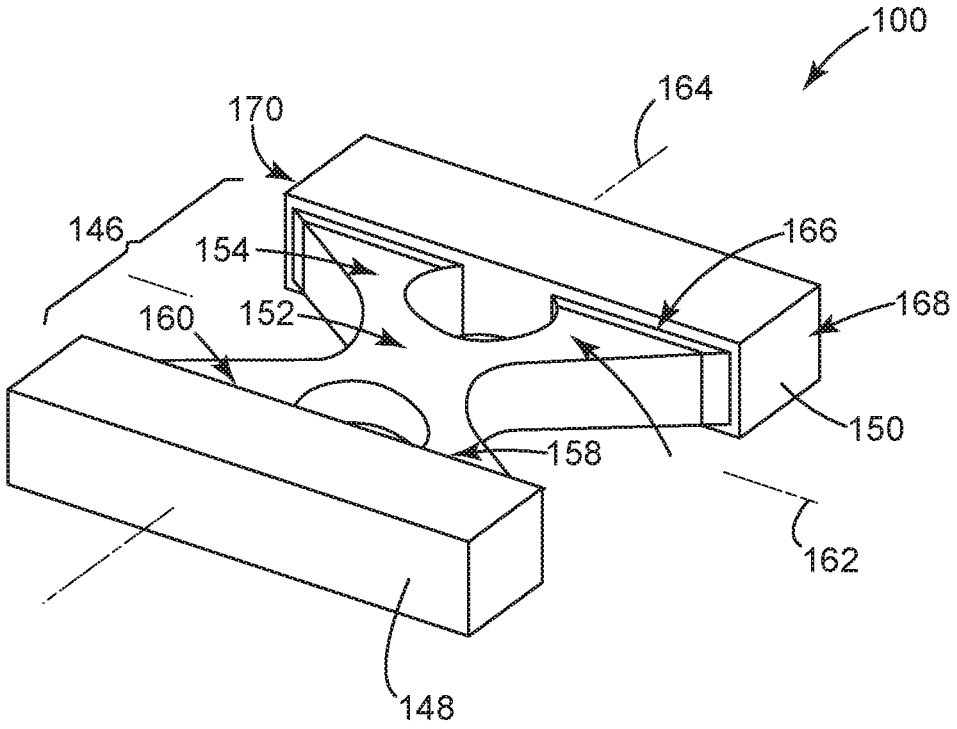
FIG. 4 depicts a perspective view of the top of an example of the support member of FIGS. 1, 2, and 3.
Figure 5:
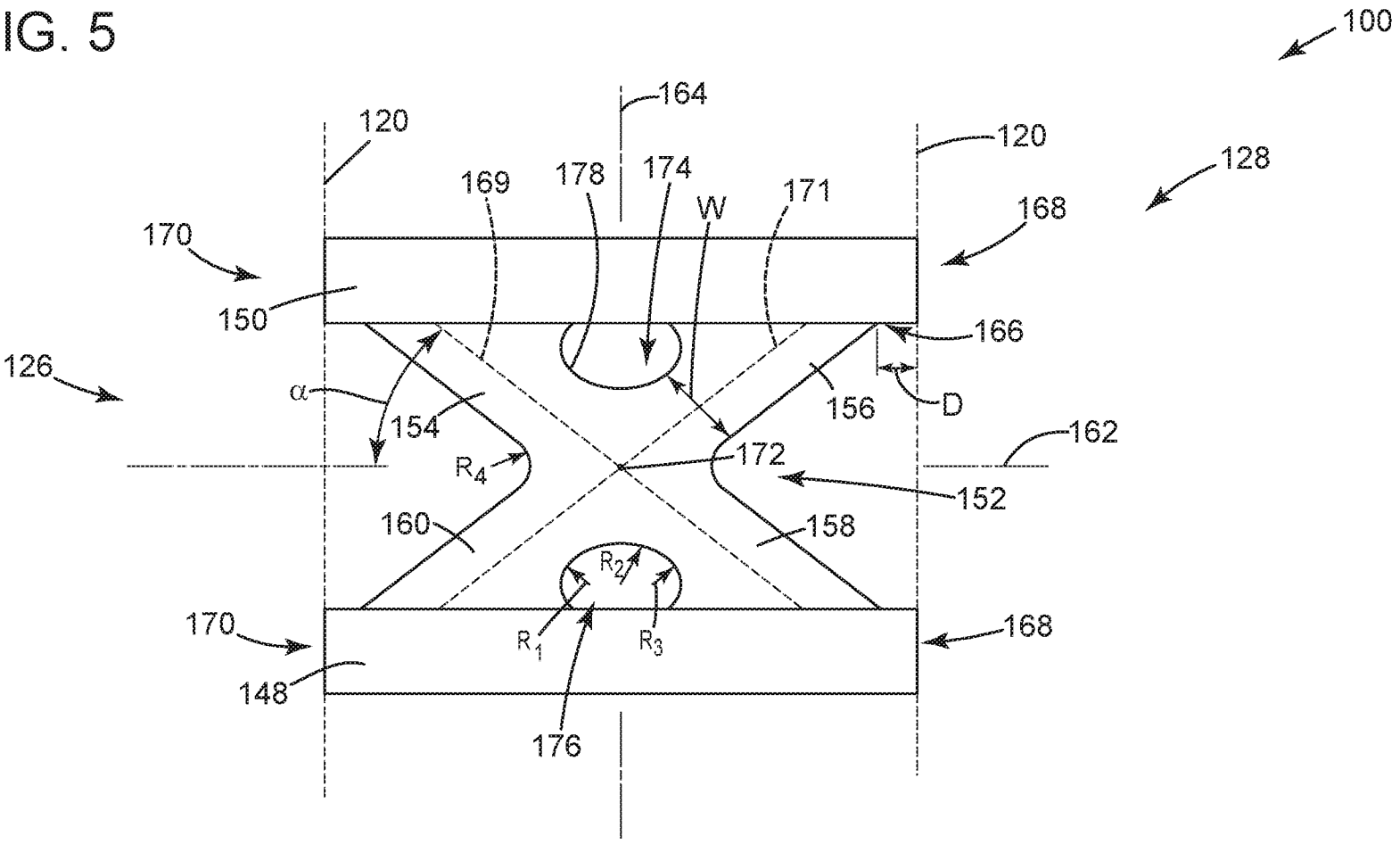
FIG. 5 depicts a plan view of the top of the example of the support member of FIG. 4.
Figure 6:
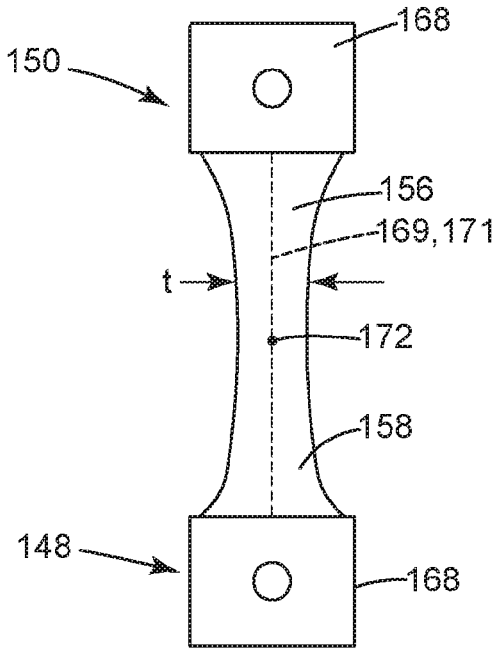
FIG. 6 depicts an elevation view of the left side of the example of the support member of FIG. 5.
Figure 7:
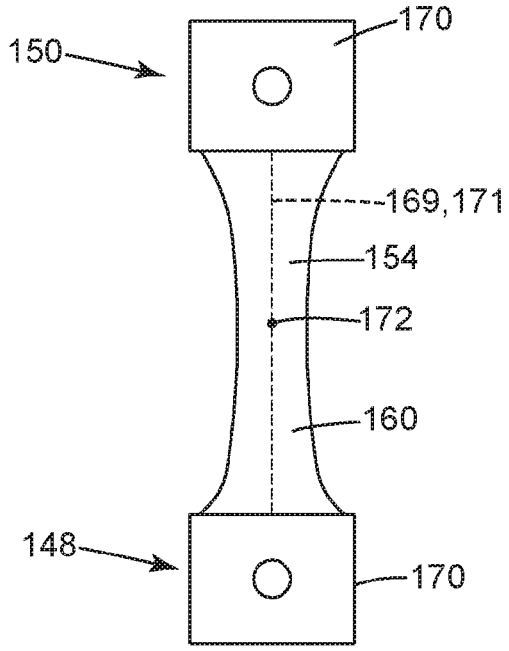
FIG. 7 depicts an elevation view of the right side of the example of the support member of FIG. 5.

FIGS. 4, 5, 6, and 7 depict various views for an example of the support member 100 to illustrate exemplary geometry for the members 146, 148, 150. FIG. 4 provides a perspective view from the top of the example. FIG. 5 depicts a plan view, also from the top of the exemplary support member 100. FIGS. 6 and 7 depict an elevation view of the sides of the exemplary support member 100.

In FIG. 4, the body of the central member 146 can assume an "x-shaped" configuration. This X-shaped configuration may include a central portion 152 and a plurality of legs (e.g., a first leg 154, a second leg 156, a third leg 158, and a fourth leg 160). The legs 154, 156, 158, 160 radiate away from the central portion 152 on either side of a pair of center planes (e.g., a longitudinal center plane 162 and an axial center plane 164). The center planes 162, 164 can bisect the body of the central member 146. As also shown in FIG. 4, the legs 154, 156 and the legs 158, 160 terminate to form a joint region 166 at either the first peripheral member 148 or the second peripheral member 150, respectively.

The joint region 166 defines a geometry that couples the legs 154, 156, 158, 160 to the peripheral members 148, 150 to provide the rigidity mentioned above. This geometry may be integral to both the legs 154, 156, 158, 160 and the peripheral members 148, 150. In one example, the geometry at the joint region 166 forms a curved or concave surface between the adjoining portions of the legs 154, 156, 158, 160 and the peripheral members 148, 150. These curved surfaces may result from the formation processes that build the casting or the result of secondary operations on the same. For fabricated constructions, the curved surfaces may result from machining, either of original billet material or weld as necessary. In one implementation, the curved surfaces can have a profile that is concave or convex with a radius of from approximately 6 mm to approximately 13 mm; although the radius may vary to accommodate manufacture (e.g., casting). The profile may at least partially circumscribe each of the legs 154, 156, 158, 160; in one example the profile circumscribes the entirety of the legs 154, 156, 158, 160.

FIG. 5 shows a plan view of the exemplary support member 100 of FIG. 4. The peripheral members 148, 150 can have ends (e.g., a first end 168 and a second end 170). The ends 168, 170 serve to interface with the walls 120 on the sides 126, 128 of the box-like unit 118. The legs 154, 158 and the legs 156, 160 are arranged as diagonal components of the x-shaped configuration, identified by the phantom lines enumerated 169, 171. In one implementation, the legs 154, 156, 158, 160 are offset from the ends 168, 170 by an offset D as measured from the surface at the end 168, 170 to the center of the radius of the curved surface at the joint region 166. Values for offset D can be approximately 13 mm, although it is contemplated that such values may be in a range of from half the radius to full radius of the curved surface in the joint area 166 or more. As also shown in FIG. 5, the diagonal components 169, 171 intersect at a center point 172 disposed on the center planes 162, 164. An angle $\alpha$ defines the orientation of the diagonal components 169, 171 relative to the axial center plane 162. Values for the angle $\alpha$ can be in a range of from approximately 30° to approximately 60°, but these values can vary often in connection with design constraints necessary to prevent deformation of the box-like unit 118.

Fabrication and/or design constraints may warrant certain geometry for use in the shaped configuration of the support member 100. With reference to FIG. 5, the legs 154, 156, 158, 160 can have a width W as measured across the front surface. Values for the width W may be at least 25 mm. These values can vary in a direction, for example, from either the peripheral members 148, 150 toward the center point 172. The width W may be largest proximate the peripheral members 148, 150 and reduce in size to a constant value (within reasonable manufacturing tolerances) to a section that includes the central portion 152 and parts of the legs 154, 156, 158, 160 on either side of the central portion. These variations may result from features (and shapes) on the inside and outside of the central portion 152, the legs 154, 156, 158, 160, and the peripheral members 148, 150. The interior of these components may form a pair of open regions (e.g., a first open region 174 and a second open region 176). The open regions 174, 176 can include an interior curved surface 178 with one or more radii (e.g., a first radii R1, a second radii R2, and a third radii R3). The radii R1, R2 may be the same, typically in a range of from half the width W to approximately the full width W. Notably, the outside of the central portion 152 of the x-shaped configuration can form a fourth radii R4. Values for this fourth radii R4 may be in a range from approximately half the width W to approximately the full width W.

FIGS. 6 and 7 depict an elevation view of the exemplary support member 100 of FIG. 4 from the right and left sides, respectively. The legs 154, 156, 158, 160 can have a thickness T as measured between the front surface and the back surface. This thickness T may be constant in direction along diagonals 169, 171 from the center point 172 towards the peripheral members 148, 150. The thickness may increase in the joint region 166, as necessary for purposes of design and incorporation of the curved surfaces discussed above. As also shown, the front surface and the back surface of the legs 154, 156, 158, 160 can be offset from the front surface and the back surface of the peripheral members 148, 150. This offset may vary depending on design considerations for support member 100 and its role in stabilizing the box-like unit 118 (FIG. 1). On the ends 168, 170, the surface of the peripheral members 145, 150 can be flat to mate with adjacent walls 120 of the box-like unit 118. Flatness may be held in a range from approximate+0.05 mm to approximately 0.05 mm.

Figure 8:
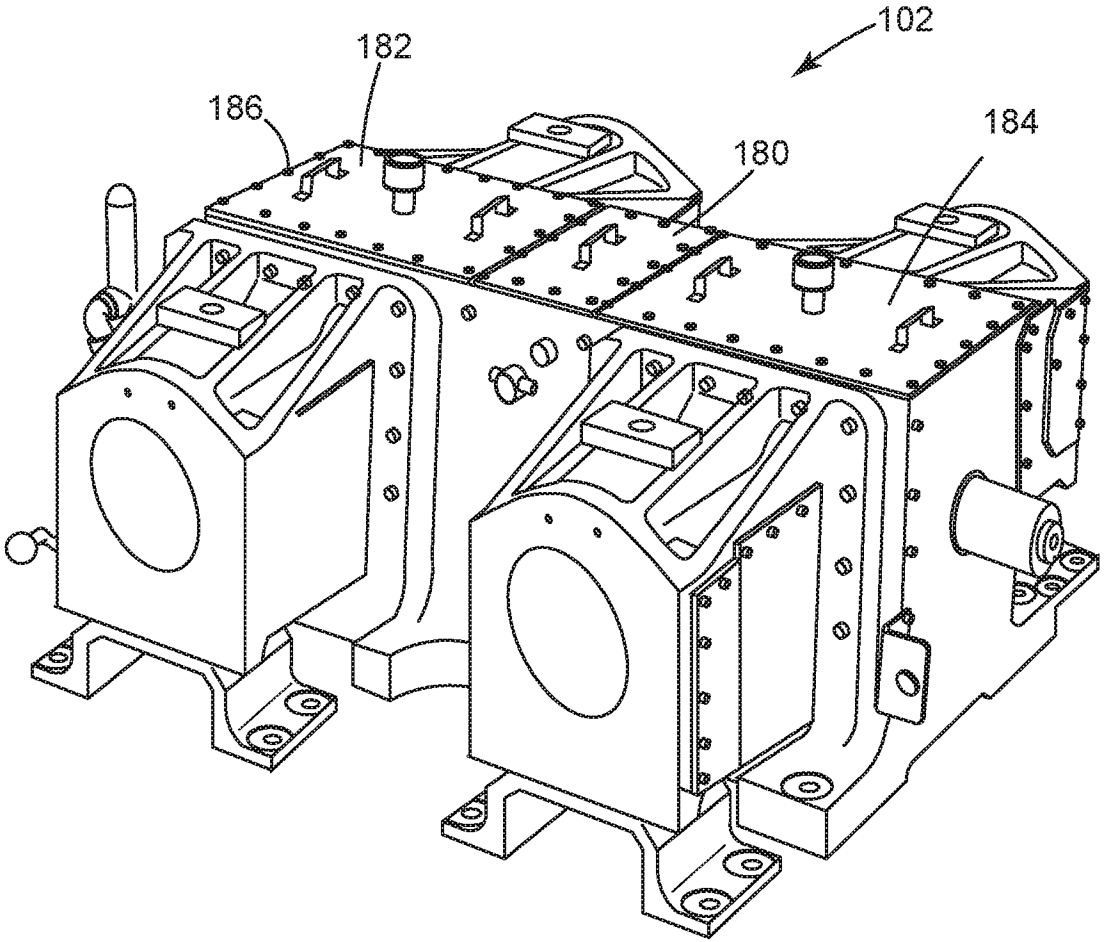
FIG. 8 depicts a perspective view of an example of the compressor of FIGS. 1, 2, and 3 in partially assembled form.

FIG. 8 illustrates a perspective view of an example of the compressor 102 in partially-assembled form. This example includes covers (e.g., a first cover 180, a second cover 182, and a third cover 184). The first cover 180 is disposed in the middle portion 140 of the opening 132 (FIG. 3). The covers 182, 184 are disposed in the peripheral portions 142, 144 (FIG. 3). Cover bolts 186 may penetrate through the covers 180, 182, 184 into adjacent portions of the walls 120, the support member 100, and the tie bars 134, 136, 138. Support bolts 188 may be useful to secure the support member 100 in position in the opening 132. To access the interior of the machine, the bolts 188 can be removed to loosen and, eventually, displace one of the covers 180, 182, 184.

In this respect, the compressor 102 may require service and maintenance to attend to parts in the unit 118. Over time, these parts may experience wear and, possibly, damage that can frustrate operation of the compressor 102. A technician may need to extract these parts, either in whole or in pieces, to remove existing parts in favor of one or more replacement parts. Examples of replacement parts may be used in place of the stability mechanism in the compressor 102 (and its derivatives) including, for example, the support member 100. The replacement parts may originate from an OEM or alternative aftermarket dealer and/or distributor. Examples of the replacement part for the support member 100 may be newly constructed using any of the conventional manufacturing and machining techniques (including additive manufacturing). For certain techniques, a model file that comprises one or more instructions of executable code (on a storage medium and/or downloadable and/or executable) may be used to define the features of the replacement part. These instructions may cause a machine (e.g., a lathe, milling machine, 3-D printing machine) to perform certain functions to result in parts for use in the compressor 102.

This disclosure also contemplates that one or more of the replacement for the support member 100 may be formed by existing parts. For example, the support member 100 may lend itself to refurbishing and like processes to prepare the existing parts into condition and/or specification for use as the replacement part in the structure. Exemplary subtractive manufacturing processes may include buffing, bead-blasting, machining, and like practices that are useful to build-up and/or remove material from the part, as desired. Exemplary additive manufacturing processes may include 3-D printing with polymers, laser metal sintering, as well as after-developed technology.

The replacement parts may be assembled into the stability mechanism of the compressor 102 as a wholly-constructed assembly. In other implementations, the replacement parts may embody individual parts (e.g., support member 100, tie bars 134, 136, 138, etc.), as well as combinations and compilations thereof, possibly in the form of one or more sub-assemblies.

Figure 9:
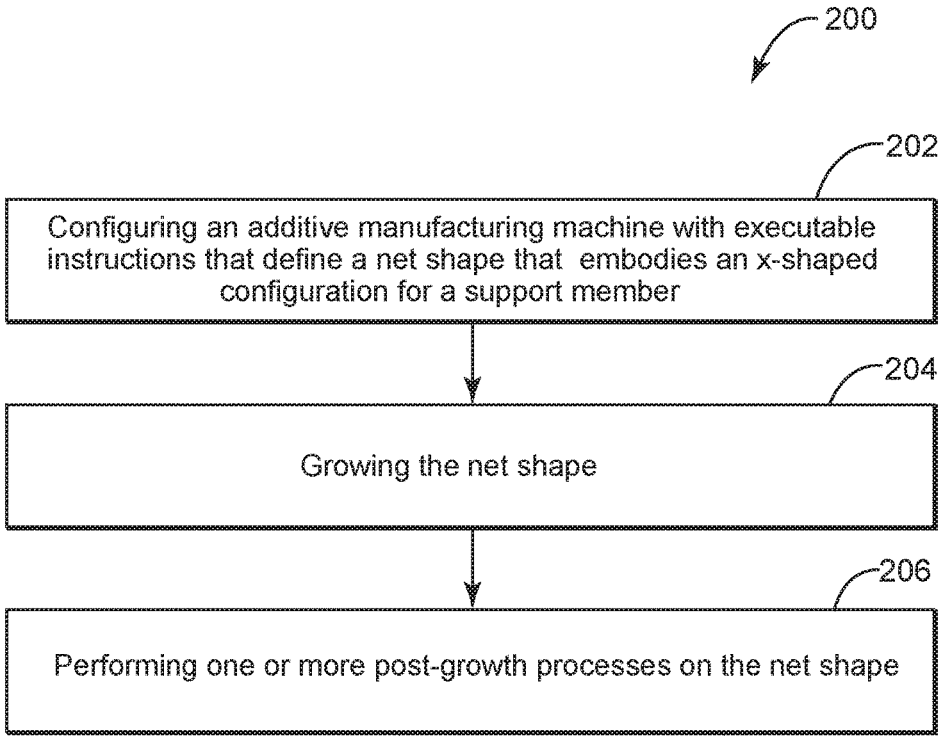
FIG. 9 depicts a flow diagram of an exemplary process to manufacture an exemplary embodiment of a support member.

FIG. 9 illustrates an exemplary process 200 to manufacture an example of the support member 100. The exemplary process may leverage additive manufacturing techniques, alone or in combination with one or more other types of subtractive manufacturing techniques. As shown in FIG. 9, the process 200 can include, at stage 202, configuring an additive manufacturing machine with executable instructions that define a net shape. The net shape can embody the body of the support member 100 including, for example, configurations (like the x-shaped configuration) of the peripheral members and the diagonal components described hereinabove. The process 200 can also include, at stage 204, growing the net shape and, where necessary, at stage 206, performing one or more post-growth processes on the net shape.

Implementations of the process 200 can render embodiments of the support member 100. These implementations may result in, for example, a support member to support a frame in a compressor made by the process of configuring an additive manufacturing machine with executable instructions that define a net shape, growing the net shape, and performing one or more post-growth processes on the net shape. Such implementation that result in the support member are also contemplated wherein the one or more post-growth processes comprises heat treating the net shape, and/or comprises deburring the net shape, and/or comprises machining the net shape, and/or comprises apply a surface finish to one or more surfaces of the net shape, and/or comprises removing material of the net shape using abrasives, and/or comprises inspecting the net shape to accumulate dimensional data and comparing the dimensional data to a default value.

As used herein, an element or function recited in the singular and proceeded with the word "a" or "an" should be understood as not excluding plural said elements or functions, unless such exclusion is explicitly recited. Furthermore, references to "one embodiment" should not be interpreted as excluding the existence of additional embodiments that also incorporate the recited features.

This written description uses examples to disclose the embodiments, including the best mode, and also to enable any person skilled in the art to practice the embodiments, including making and using any devices or systems and performing any incorporated methods. The patentable scope of the embodiments is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A compressor, comprising:

a central frame having members that form an interior cavity with an opening to allow access therein; and a stability mechanism disposed in the opening and coupled with the members of the central frame, the stability mechanism comprising a support member and a first tie bar, the support member dimensionally larger than the first tie bar so as to cover more area of the opening than the first tie bar, wherein the support member comprises a central member and a pair of peripheral members, and wherein the central member has a plurality of legs radiating from a center point to the peripheral members.

2. The compressor of claim 1, wherein the plurality of legs form an x-shaped configuration.

3. The compressor of claim 1, wherein the plurality of legs form a pair of diagonal components that intersect at the center point.

4. The compressor of claim 1, wherein the plurality of legs form an angle relative to a centerplane that intersects the central point, and wherein the angle is from 30° to 60°.

5. The compressor of claim 1, wherein the plurality of legs adjoin the peripheral members at a joint region that forms a curved surface.

6. The compressor of claim 1, wherein the plurality of legs have a width that varies in a direction from the peripheral members to the center point.

7. The compressor of claim 1, wherein the support member is removable from the central frame.

8. The compressor of claim 1, wherein the central frame has a center portion and a pair of peripheral portions disposed on either side of the center portion, wherein the central member is disposed in the center portion and the tie bar is disposed in one of the peripheral portions.

9. The compressor of claim 8, wherein the stability mechanism comprises a second tie bar and a third tie bar, each disposed in one of the peripheral portions.

10. A compressor, comprising:

a central frame with an opening into an interior cavity;

a plurality of tie bars extending across the opening; and a support member extending across the opening in between the plurality of tie bars, the support member comprising a pair of peripheral members spaced apart from one another and a plurality of legs disposed therebetween, wherein the plurality of legs are arranged as diagonal components and are coupled with the pair of peripheral members, wherein the plurality of legs have a width that varies in a direction from the peripheral members to a central point formed by two centerplanes that bisect the support member, one each in a horizontal direction and a longitudinal direction.

11. The compressor of claim 10, wherein the support member is removable from the central frame.

12. The compressor of claim 10, wherein the plurality of legs form an angle relative to the centerplane in the horizontal direction, and wherein the angle is from 30° to 60°.

13. The compressor of claim 10, further comprising bearings disposed in the interior cavity, wherein the support member is located in a position in the opening that is set-off from the bearings.

14. The compressor of claim 13, wherein the support member is disposed proximate a centerplane of the central frame.

15. The compressor of claim 10, wherein the peripheral members have a first side and a second side, each with a surface that contacts the central frame.

16. A reciprocating machine, comprising:

a frame with walls forming an interior cavity with an opening to allow access therein;

a shaft assembly disposed in the interior cavity;

bearings disposed on the shaft;

a support member disposed in the interior cavity proximate the opening in the frame top and between the bearings, the support member comprising, a pair of peripheral members, each having an elongated, rectangular body that couples with the frame; and a pair of diagonal components, each extending between the peripheral members to intersect with one another at a central point; and a pair of tie bars disposed on either side of the support member.

17. The reciprocating machine of claim 16, wherein the pair of diagonal components form an angle relative to a centerplane disposed between the peripheral members, and wherein the angle is from 30° to 60°.

18. The reciprocating machine of claim 16, wherein the support member is dimensionally larger than each of the pair of tie bars so as so as to cover more area of the opening than either of the pair of tie bars individually.

* * * * *